US009016931B2

(12) United States Patent
Rumph

(10) Patent No.: US 9,016,931 B2
(45) Date of Patent: Apr. 28, 2015

(54) TANK AGITATION SYSTEM WITH MOVEABLE SHAFT SUPPORT

(71) Applicant: Robert M. Rumph, Sumter, SC (US)

(72) Inventor: Robert M. Rumph, Sumter, SC (US)

(73) Assignee: Sumter Transport, Sumter, SC (US)

( * ) Notice: Subject to any disclaimer, the term of this patent is extended or adjusted under 35 U.S.C. 154(b) by 0 days.

(21) Appl. No.: 14/078,175

(22) Filed: Nov. 12, 2013

(65) Prior Publication Data

US 2014/0133266 A1 May 15, 2014

Related U.S. Application Data

(60) Provisional application No. 61/725,388, filed on Nov. 12, 2012.

(51) Int. Cl.

| | |
|---|---|
| ***B01F 7/04*** | (2006.01) |
| ***B01F 7/00*** | (2006.01) |
| ***B01F 15/00*** | (2006.01) |
| ***B01F 3/12*** | (2006.01) |

(52) U.S. Cl.

CPC ..... *B01F 7/00116* (2013.01); *B01F 7/00175* (2013.01); *B01F 7/00291* (2013.01); *B01F 7/0095* (2013.01); *B01F 15/00863* (2013.01); *B01F 3/1221* (2013.01)

(58) Field of Classification Search

CPC ..... B01F 7/00941; B01F 7/0095; B01F 15/00896

USPC ..... 366/285, 286, 289, 302–304, 307

See application file for complete search history.

(56) References Cited

U.S. PATENT DOCUMENTS

| | | | | |
|---|---|---|---|---|
| 155,212 | A | | 9/1874 | White |
| 421,577 | A | * | 2/1890 | Kaestner ..... 366/286 |
| 429,484 | A | | 6/1890 | Schillinger |
| 510,545 | A | | 12/1893 | Mclennan |
| 539,288 | A | | 5/1895 | Mclennan |
| 859,943 | A | * | 7/1907 | Holden ..... 366/285 |
| 912,125 | A | | 2/1909 | Hassam |
| 1,192,478 | A | | 7/1916 | Vadercook |
| 1,313,361 | A | | 8/1919 | White |
| 1,351,352 | A | | 8/1920 | Stevens |
| 1,510,514 | A | | 10/1924 | Walker |
| 1,592,713 | A | | 7/1926 | Bendixen |
| 1,618,669 | A | | 2/1927 | Morrell |
| 1,625,960 | A | | 12/1927 | Snelling et al. |
| 1,733,244 | A | | 10/1929 | Smith |
| 1,915,757 | A | | 12/1930 | Pierce |
| 1,854,761 | A | | 4/1932 | Perkins |
| 1,872,622 | A | | 8/1932 | Donahue |

(Continued)

*Primary Examiner* — David Sorkin

(74) *Attorney, Agent, or Firm* — Finnegan, Henderson, Farabow, Garrett & Dunner, LLP

(57) ABSTRACT

An apparatus for containing and mixing a load of liquids and solids is disclosed. The apparatus includes an elongated tank, which includes a lower portion and an upper portion. The apparatus further includes an elongated rotatable shaft within the tank. At least one blade is connected to the shaft and is configured to mix the liquids and solids when the shaft is rotated. The apparatus also includes a shaft support configured for maintaining the shaft in a rotatable manner within the tank. The shaft support is selectively moveable in a manner permitting the shaft to move in an upward direction from the lower portion toward the upper portion, and in a downward direction from the upper portion toward the lower portion. An is contained with the tank for moving the shaft support in the upward direction and in the downward direction.

25 Claims, 4 Drawing Sheets

(56) References Cited

U.S. PATENT DOCUMENTS

| | | | | | |
|---|---|---|---|---|---|
| 1,891,122 | A | | 12/1932 | Urch | |
| 1,893,451 | A | | 1/1933 | Smith | |
| 1,896,616 | A | | 2/1933 | Gillican | |
| 2,052,544 | A | | 9/1936 | Bartholomew | |
| 2,077,445 | A | | 4/1937 | Wallace et al. | |
| 2,081,850 | A | | 5/1937 | Darby et al. | |
| 2,081,851 | A | | 5/1937 | Darby et al. | |
| 2,081,852 | A | | 5/1937 | Darby et al. | |
| 2,108,416 | A | | 2/1938 | Smith et al. | |
| 2,210,160 | A | | 12/1938 | Beal | |
| 2,322,720 | A | | 2/1941 | Scott et al. | |
| 2,277,890 | A | | 3/1942 | Stendorf | |
| 2,411,138 | A | | 11/1946 | Roberts | |
| 2,440,397 | A | | 4/1948 | Erickson | |
| 2,519,657 | A | | 8/1950 | Hunter | |
| 2,522,077 | A | | 9/1950 | Wahl et al. | |
| 2,573,521 | A | | 10/1951 | Wasley et al. | |
| 2,635,859 | A | | 4/1953 | Dreyfus | |
| 2,767,965 | A | | 10/1956 | Daman | |
| 2,780,369 | A | | 2/1957 | Kaney | |
| 2,791,406 | A | | 5/1957 | Bates | |
| 2,852,581 | A | | 9/1958 | Stiles | |
| 2,859,259 | A | | 11/1958 | Stiles | |
| 2,872,166 | A | | 2/1959 | Roberts | |
| 2,891,675 | A | | 6/1959 | Kaplon | |
| 2,903,344 | A | | 9/1959 | Rollman et al. | |
| 2,920,124 | A | | 1/1960 | Stiles et al. | |
| 2,950,171 | A | | 8/1960 | Macq | |
| 2,965,364 | A | | 12/1960 | Parker et al. | |
| 3,111,954 | A | | 11/1963 | Duncan | |
| 3,120,948 | A | * | 2/1964 | Stratienko | 366/331 |
| 3,139,100 | A | | 6/1964 | Griparis | |
| 3,165,300 | A | | 1/1965 | Balistrieri | |
| 3,170,675 | A | | 2/1965 | Cairnie | |
| 3,235,232 | A | | 2/1965 | Conover | |
| 3,180,628 | A | | 4/1965 | Pullin | |
| 3,189,080 | A | | 6/1965 | Overcashier et al. | |
| 3,194,639 | A | | 7/1965 | Brown et al. | |
| 3,201,175 | A | | 8/1965 | Keves et al. | |
| 3,257,174 | A | | 6/1966 | Fournell | |
| 3,259,261 | A | | 7/1966 | Gallagher | |
| 3,316,023 | A | | 4/1967 | Koranda | |
| 3,321,190 | A | | 5/1967 | Mott | |
| 3,338,635 | A | | 8/1967 | Koranda | |
| 3,375,942 | A | | 4/1968 | Boram | |
| 3,379,415 | A | | 4/1968 | Logue | |
| 3,424,438 | A | | 1/1969 | Knotts et al. | |
| 3,451,724 | A | | 6/1969 | Cappelli et al. | |
| 3,469,824 | A | | 9/1969 | Futty et al. | |
| 3,512,842 | A | | 5/1970 | Milewski et al. | |
| 3,532,327 | A | | 10/1970 | Landberg | |
| 3,559,595 | A | | 2/1971 | Appelhans et al. | |
| 3,606,036 | A | | 9/1971 | Beebe et al. | |
| 3,606,479 | A | | 9/1971 | Robinson et al. | |
| 3,638,723 | A | | 2/1972 | Carroll | |
| 3,642,254 | A | | 2/1972 | Ternes | |
| 3,684,250 | A | | 8/1972 | Roeser | |
| 3,693,795 | A | | 9/1972 | Robinson et al. | |
| 3,748,081 | A | | 7/1973 | Hummell | |
| 3,756,170 | A | | 9/1973 | Lang | |
| 3,810,604 | A | | 5/1974 | Reiter | |
| 3,951,581 | A | | 4/1976 | Nakayama et al. | |
| 4,023,777 | A | | 5/1977 | Kimmel | |
| 4,032,261 | A | | 6/1977 | Madan | |
| 4,082,227 | A | | 4/1978 | McGrane et al. | |
| 4,157,872 | A | | 6/1979 | Davido | |
| 4,175,039 | A | | 11/1979 | Fisher | |
| 4,187,029 | A | | 2/1980 | Canale et al. | |
| 4,223,622 | A | | 9/1980 | Mazzucato et al. | |
| 4,289,428 | A | | 9/1981 | Hiorns | |
| 4,298,289 | A | | 11/1981 | Walley | |
| 4,329,069 | A | | 5/1982 | Graham | |
| 4,378,165 | A | | 3/1983 | Landberg | |
| 4,390,286 | A | | 6/1983 | Regaldo | |
| 4,407,622 | A | | 10/1983 | Ito | |
| 4,410,279 | A | | 10/1983 | Howden et al. | |
| 4,412,747 | A | | 11/1983 | Moriyama | |
| 4,416,549 | A | | 11/1983 | Kretschmer | |
| 4,431,597 | A | * | 2/1984 | Cramer et al. | 261/93 |
| 4,441,824 | A | | 4/1984 | Brokaw | |
| 4,449,826 | A | * | 5/1984 | Mathis et al. | 366/13 |
| 4,464,259 | A | | 8/1984 | Cramer et al. | |
| 4,519,714 | A | | 5/1985 | Johnson et al. | |
| 4,542,992 | A | | 9/1985 | Markhart | |
| 4,552,460 | A | | 11/1985 | Wallace | |
| 4,555,063 | A | | 11/1985 | Goettsch | |
| 4,571,090 | A | | 2/1986 | Weetman et al. | |
| 4,599,004 | A | | 7/1986 | Keith | |
| 4,642,138 | A | | 2/1987 | Koyase et al. | |
| 4,663,039 | A | | 5/1987 | Lindorfer et al. | |
| 4,671,872 | A | | 6/1987 | Cramer et al. | |
| 4,685,868 | A | | 8/1987 | Bodensteiner et al. | |
| 4,708,775 | A | | 11/1987 | McGregur et al. | |
| 4,715,721 | A | | 12/1987 | Walker et al. | |
| 4,721,392 | A | | 1/1988 | Fries et al. | |
| 4,746,221 | A | | 5/1988 | Okumura et al. | |
| 4,756,626 | A | | 7/1988 | Neier | |
| 4,844,664 | A | | 7/1989 | Turska | |
| 4,944,600 | A | | 7/1990 | McKelvey | |
| 4,981,366 | A | | 1/1991 | Wickorn | |
| 5,005,364 | A | | 4/1991 | Nelson | |
| 5,013,530 | A | | 5/1991 | McGregor | |
| 5,078,799 | A | | 1/1992 | Matter et al. | |
| 5,147,133 | A | | 9/1992 | White | |
| 5,222,512 | A | | 6/1993 | McGregor | |
| 5,269,604 | A | | 12/1993 | Ewers | |
| 5,275,487 | A | | 1/1994 | Rumph | |
| 5,282,681 | A | * | 2/1994 | Supelak | 366/246 |
| 5,340,213 | A | | 8/1994 | Rumph | |
| 5,366,289 | A | | 11/1994 | Supelak | |
| 5,385,402 | A | | 1/1995 | Rumph | |
| 5,395,593 | A | | 3/1995 | Martin | |
| 5,489,152 | A | | 2/1996 | Rumph | |
| 5,626,423 | A | | 5/1997 | Rumph | |
| 5,851,068 | A | | 12/1998 | Rumph | |
| 5,919,377 | A | | 7/1999 | Chisholm et al. | |
| 6,276,825 | B2 | * | 8/2001 | Running et al. | 366/270 |
| 6,276,826 | B1 | | 8/2001 | Rumph | |
| 6,333,446 | B1 | | 12/2001 | Rumph | |
| 6,443,613 | B1 | | 9/2002 | Rumph | |
| 6,540,871 | B1 | | 4/2003 | Rumph | |
| 6,641,297 | B2 | | 11/2003 | Rumph | |
| 6,851,845 | B2 | | 2/2005 | Rumph | |
| 6,964,511 | B2 | | 11/2005 | Rumph | |

* cited by examiner

TANK AGITATION SYSTEM WITH MOVEABLE SHAFT SUPPORT

CROSS-REFERENCE TO RELATED APPLICATION

The present application claims the benefit of Provisional Application No. 61/725,388, filed Nov. 12, 2012, the contents of which are incorporated herein by reference.

FIELD

Embodiments of this disclosure relate generally to an apparatus for containing and mixing a load of liquids and solids. More particularly, embodiments of the present disclosure relate to apparatuses for mixing a load of liquids and solids contained in an elongated tank.

BACKGROUND OF THE INVENTION

Solids materials are often transported in mixture with liquids, either because the mixture in-and-of itself is desired, or because the addition of liquids to solids aids in the handling of the solids. For example, it is often easier to unload material from a tank when the material is in flowable form. Such mixtures or slurries can include for example, hazardous waste, non-hazardous waste, raw solids material, processed solids, beads, pellets, particles, grains, or chemical compounds contained in at least partial suspension with a diluent. In some instances the suspension may be substantially homogeneous, and in others it may be non-homogenous. The solids can be any pulverized, particulate, or other solids material which when mixed with a diluent, may become at least partially flowable. Examples of diluents include solvents, water, naphtha, paint thinner, bitumen, and other petroleum based materials; condensate, or any other liquid or material sufficient to render a mixture flowable.

When transporting mixtures over long distances, via road, rail, sea, or air, extended transportation time may facilitate a settling of solids on a bottom portion of a tank. When transportation time extends over many hours, days or even weeks, the challenge may increase significantly. For example, solids may settle in the liquids and gradually form a sediment on the bottom of a storage container e.g., tank, during storage and/or transport. As loads shift, the solids sediment may have varying thickness on the floor of the tank. As a slurry or other mixture is unloaded from the tank, the liquids portion of the mixture may be readily removed while a portion of the solids sediment may remain in the tank.

Depending on the particular circumstance, the retention of solids in the bottom of the tank may pose a number of challenges. Added cost may be required to remove retained solids, or otherwise, the tank's capacity may be diminished. In addition, if uniformity is desired at the time of tank unloading, a sedimentary tank may result in uniformity variances at the time of unloading. Depending on the circumstance, concentration differences or non-homogeneity may be undesirable at a receiving facility, and may result in rejection of the shipment of waste materials.

Raw material, virgin materials, and materials to be used in industrial processes may be transported without a portion of the liquid (e.g., water or solvents) in order to save weight and/or increase capacity. Adding liquids to the top of a load prior to offloading to reconstitute the materials into a mixture may also prove challenging.

In order to address these issues, tanks have been designed to include an agitator system to stir the mixture so that the slurry may be in a homogenous state when discharged from the tank. With some of these systems, the agitator may become embedded in solids material and may have difficulty mixing waste.

SUMMARY OF A FEW ASPECTS OF THE INVENTION

An apparatus for containing and mixing a load of liquids and solids is disclosed. The apparatus may include an elongated tank for containing the load. The tank may have a lower portion and an upper portion. The apparatus may further include an elongated rotatable shaft within the tank and at least one blade connected to the shaft. The blade may be configured to mix the liquids and solids when the shaft is rotated. The apparatus may also include a shaft support configured for maintaining the shaft in a rotatable manner within the tank. The shaft support may be selectively moveable in a manner permitting the shaft to move in an upward direction from the lower portion toward the upper portion, and in a downward direction from the upper portion toward the lower portion. The apparatus may further include an actuator contained with the tank for moving the shaft support in the upward direction and in the downward direction.

In various embodiments, the apparatus may include one or more of the following additional features: the apparatus may be mobile; the elongated tank may be an ISO tank and include a rectangular outer frame; the elongated tank may be adapted to contain a hazardous load; the at least one blade may have a substantially flat surface portion; the at least one blade may include a plurality of blades; the actuator may be configured for rotating the shaft; the actuator may be configured to move the shaft support up to a predefined position; the actuator may be configured for concurrently regulating the shaft support movement to the downward direction and rotating the shaft; the apparatus may further include a feedback mechanism configured to control at least downward movement of the shaft support as a function of rotational resistance of the shaft; the actuator may include at least one of a pneumatic cylinder, pneumatic piston, a gear, a belt, a chain, and a screw; the shaft may be connected to the shaft support in at least two locations; the shaft support may be mounted on a hinge on one side of the tank, and the actuator may be configured to cause the support to pivot about the hinge; the apparatus may be configured to mix the load into a substantially uniform blend of solids and liquids; the apparatus may further include a hydraulic motor for rotating the shaft; a sensor configured to measure a hydraulic fluid pressure level; and a processor configured to regulate downward movement of the shaft support as a function of the measured hydraulic fluid pressure level.

An apparatus for mixing a load of liquids and solids, adapted to be configured within an elongated tank that includes a lower portion and an upper portion is also disclosed. The apparatus may include an elongated rotatable shaft and at least one blade connected to the shaft. The blade may be configured to mix the liquids and solids when the shaft is rotated. The apparatus may further include a movable shaft support configured for maintaining the shaft in a rotatable manner within the tank. The shaft support may be selectively moveable in a manner permitting the shaft to move in an upward direction from the lower portion toward the upper portion, and in a downward direction from the upper portion toward the lower portion.

In various embodiments, the apparatus may include one or more of the following additional features: the apparatus may further include an actuator for regulating the shaft support movement to the upward direction and to the downward direction; and the apparatus may further include a sensor and a processor for determining when to move the shaft in the downward direction.

A method for mixing a load of liquids and solids contained in elongated tank including a lower portion and an upper portion is also disclosed. The method may include upon loading the tank with the load of liquids and solids, rotating an elongated shaft connected to at least one blade within the tank. The method may further include selectively moving the shaft in a manner permitting the shaft to move in an upward direction from the lower portion toward the upper portion, and in a downward direction from the upper portion toward the lower portion. The method may also include repeating the steps until the load is mixed to a substantially uniform blend of solids and liquids.

In various embodiments, the step of selectively moving the shaft may take place concurrently with the rotating step.

An apparatus for containing and mixing a load of liquids and solids is also disclosed. The apparatus may include an elongated tank for containing the load and at least one baffle partitioning the tank into at least two sections. The apparatus may further include an elongated rotatable shaft within the tank, passing through the at least one baffle. The shaft may have opposing shaft ends completely contained within the tank such that tank walls are impervious to the shaft. The apparatus may further include at least one blade connected to the shaft. The blade may be configured to mix the liquids and solids when the shaft is rotated.

In various embodiments, the apparatus may include one or more of the following additional features: the at least one baffle may be constructed of a plurality of sheets of metal having reinforcing ribs between edges of the metal sheets; the at least one baffle may be constructed to withstand a g-force of at least 1.5 g; the apparatus may further include a shaft support for rotatably holding the shaft, the shaft support being movable toward and away from a bottom of the tank; and the at least one baffle may include a gap therein, the shaft being configured to pass through the gap.

Additional aspects of the disclosure and exemplary objects and advantages of the disclosure will be set forth in part in the description that follows, and in part will be understandable from the description, or may be learned by practice of the disclosed embodiments.

The accompanying drawings, which are incorporated in and constitute a part of this specification, illustrate one embodiment and together with the description, serve to explain various alternative principles of the invention.

DESCRIPTION OF EXEMPLARY EMBODIMENTS

Reference will now be made in detail to exemplary embodiments of the present disclosure, examples of which are illustrated in the accompanying drawings. Wherever possible, the same reference numbers will be used throughout the drawings to refer to the same or like parts.

In some embodiments of the invention, an apparatus may be provided for containing and mixing a load of solids and liquids. The term "a load of liquids and solids" refers to any substance having solid and liquid constituents. Such substances may be, for example, hazardous or non-hazardous materials including by products or waste from industrial processes, or virgin materials, raw material, or other materials having liquid and solid constituents. Hazardous waste may include waste that possesses substantial or potential threats to public health or the environment. Some waste materials may include sodium chlorate, clay, salt slurries, leftover paints, paint thinners, paint solvents, paint cleaning compositions, black liquor, industrial mixtures, refineries slurries, and/or any other known waste material. Non-hazardous waste materials may include food materials such as, for example, wheat, and calcium carbonate. Organic and inorganic compounds and chemicals such as, for example, catalyst solutions, synthetic asphalt emulsions, crude oil, slop oil, and miscellaneous chemical tank bottom sediments.

Figure 1:
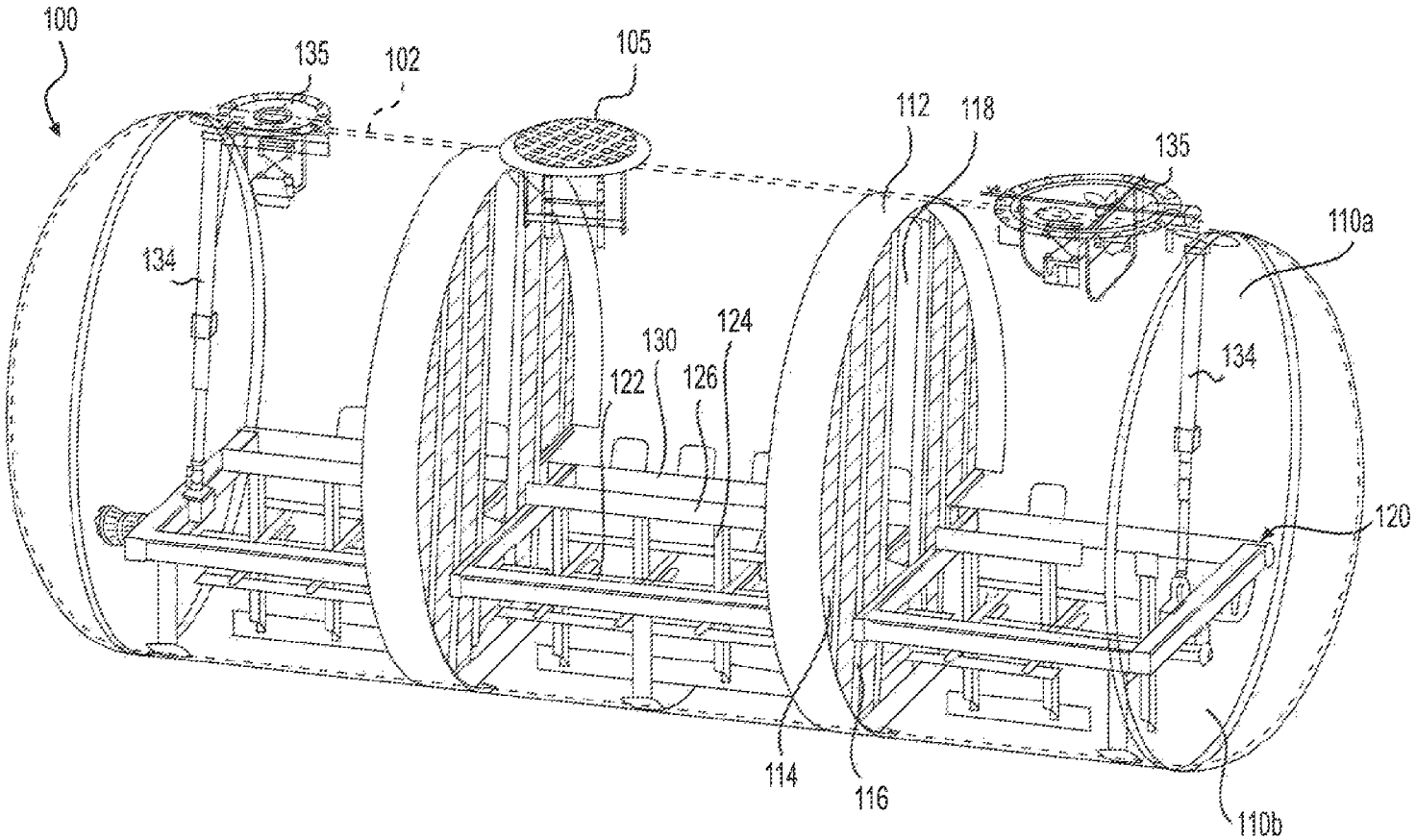
FIG. 1 illustrates a perspective view of an apparatus including an agitator system disposed in an elongated tank, according to an embodiment of the disclosure.

In the exemplary embodiment shown in FIG. 1, apparatus 100 may include an elongated tank 102 for containing a load, and an agitator system 120 configured to mix the load. In certain embodiments, apparatus 100 may be configured to be associated with a mobile vehicle such as, for example, a trailer, truck, rail car, ship, barge, or boat on which elongated tank 102 is mounted or otherwise configured to be transported. Alternatively, apparatus 100 may be associated with a stationary system such as, for example, a stationary tank system.

As used herein and throughout the disclosure, the term "elongated tank" may refer to any closed or closable reservoir adapted to contain a load of liquids and solids and containing a transverse axis. An exemplary elongated tank 102 is shown in FIG. 1. Elongated tank 102 may be formed of stainless steel, carbon steel, or any other material of similar or greater durability. In certain embodiments, elongated tank 102 may have a substantially circular cross-section and a cylindrical shape, such as a tank adapted to contain between 10,000 to 250,000 gallons of material. The tank may be mounted on a chassis and/or may be contained within a frame that prevents the tank from rolling. In the exemplary disclosed embodiment, elongated tank 102 may be between 15 feet and 75 feet, while the cross-sectional diameter may be between 6 feet and 12 feet. It will be understood that these dimensions of elongated tank 102 are merely illustrative. Additional shapes, cross-sections, and dimensions for tank 102 are envisioned and are considered within the scope of this disclosure.

Elongated tank 102 may be designed to meet the United States Department of Transportation Hazardous Waste Transport Standard MC 307 and MC 312, which includes requiring that the empty tank does not leak when subjected to an air pressure of 1.76 kilograms per square meter. In an alternative embodiment, elongated tank 102 may be a tank as specified in American Petroleum Institute Standards No. 650, Welded Steel Tanks for Oil Storage. In such an embodiment, elongated tank 102 may be formed from a plurality of walls that have edges joined with welded seams e.g., a frac tank. In yet other embodiments, elongated tank may be a tank compliant with the ISO Standard. In the exemplary embodiment, elongated tank 102 may meet United States Department of Transportation Hazardous Waste transport standard MC 307 and MC 312.

At least one manhole 105 may be provided on elongated tank 102. The at least one manhole 105 may provide access to the interior of elongated tank 102. Although the depicted embodiment includes one manhole 105, a greater or lesser number of manholes may be provided. Additional openings or orifices (not shown) may also be provided for the discharge of the load from elongated tank 102.

In some embodiments, the interior of elongated tank 102 may have an upper portion 110*a* and a lower portion 110*b*. As used herein and throughout the disclosure, the terms "upper portion" and "lower portion" generally refer to two regions of an interior of elongated tank 102, where lower portion 110*b* is closer to the ground than upper portion 110*a*. When apparatus 100 contains a load of liquids and solids for a length of time, solids may, due to gravity, settle in lower portion 110*b* of elongated tank 102 and liquids may remain above the solids either in a higher elevation of the lower portion 110*b* or in upper portion 110*a* of elongated tank 102. In some uses, solids may be purposefully loaded in lower portion 110*b* with liquids loaded above in portion 110*a*. Or, a mixture may be loaded and permitted to stratify in such a way. In either instance, the disclosed structure may be used to later constitute, or reconstitute the mixture.

In some embodiments of the invention, elongated tank 102 may also include horizontal sections. For example, elongated tank 102 may include at least one baffle 112 partitioning an interior of elongated tank 102 into at least two sections. As used herein, the term "baffle" refers to any construction located inside elongated tank 102 that may provide a complete or partial barrier to fluid flow. Although the depicted embodiment includes two baffles 112, elongated tank 102 may include a greater or lesser number of baffles 112. It is to be understood that the number of baffles 112 may depend on, for example, the length of elongated tank 102. In some embodiments of the invention, no baffles may be employed.

Baffles 112 may be constructed of steel or other materials configured to provide a complete or partial barrier to fluid flow. In certain embodiments, baffles 112 may be constructed of a plurality of sheets of metal 114 and include reinforcing ribs 116 between edges of the metal sheets 114. In an alternative embodiment, baffles 112 may be constructed as a single wall. In both embodiments, baffles 112 may include an elongated opening 118 therein to receive a portion of agitator system 120. The elongated opening 118 may extend from lower portion 110*b* of tank 102 toward upper portion 110*a*. This may provide freedom of movement for the agitator system to move upward and downward in the tank, as will be described later in greater detail.

Figure 2:
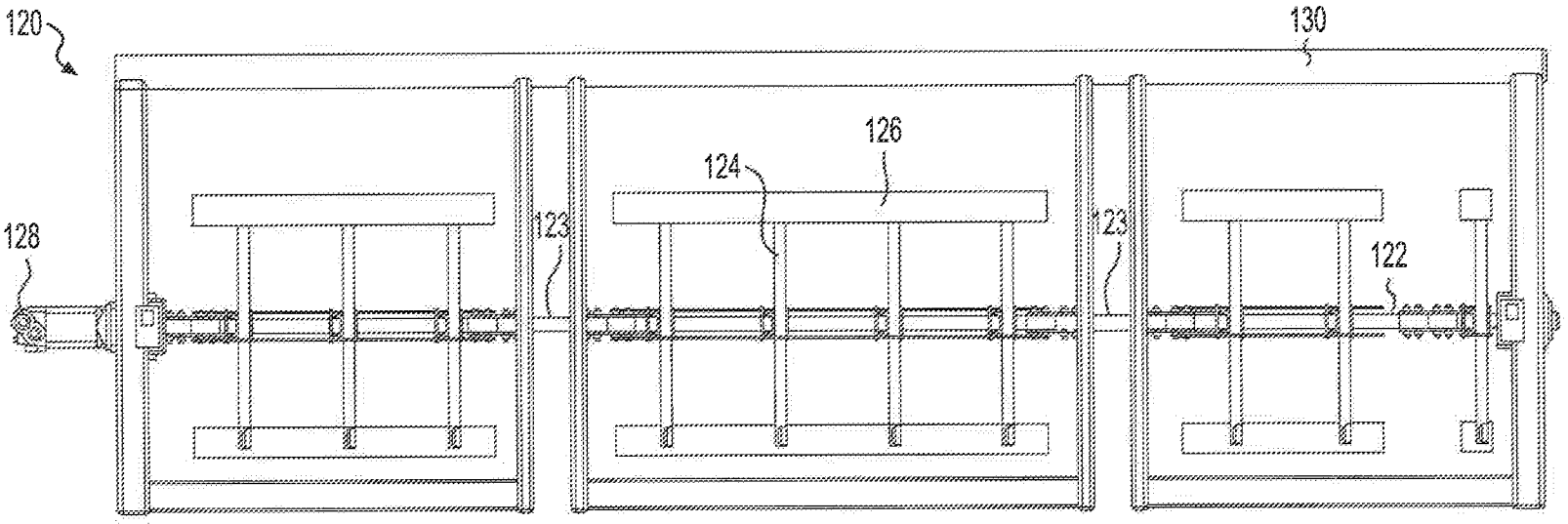
FIG. 2 is a top view of the agitator system, according an embodiment of the disclosure.

Agitator system 120 may be disposed within elongated tank 102, and, in some embodiments, may include a shaft 122, at least one blade 126, and a shaft support 130. Referring to FIGS. 1 and 2, shaft 122 may be rotatably maintained by shaft support 130, and connected to at least one blade 126 via at least one radial arm 124. The at least one blade 126 may be configured to mix a load of liquids and solids when shaft 122 is rotated.

As used herein and throughout the disclosure, the term "shaft" may refer to any known elongate structure capable of rotating. For example, shaft 122 may be a solid rod or tube. Shaft 122 may be made from any suitable material known to one of ordinary skill in the art having sufficient durability to support at least one radial arm 124 and at least one blade 126. Such materials may include, but are not limited to, stainless steel and aluminum. In certain embodiments, shaft 122 may be made from aluminum to keep the weight of apparatus 100 as low as possible. It is contemplated that shaft 122 may be constructed from a single piece of material or may be made of multiple segments of either joined or unjoined material.

Shaft 122 may have any cross-sectional shape and/or configuration, and may be any desired dimension that may be positioned in an interior of elongated tank 102. For example, shaft 122 may be sized so that the opposing ends of shaft 122 are completely contained within elongated tank 102 such that tank walls are impervious to shaft 122. In one embodiment, shaft 122 may be constructed from a stainless steel rod and have a diameter of between ⅛ inch to 24 inches, and a length of about 172 inches. Shaft 122 may include segments 123 free of any radial arms 124 and/or blades 126, which may be received by elongate openings 118 of baffles 112.

At least one radial arm 124 may be affixed to shaft 122 which, in turn, may have at least one blade 126 affixed thereto. As used herein and throughout the disclosure, the term "radial arm" may refer to any known structure adapted to support at least one blade. As used herein and throughout the disclosure, the term "at least one blade" may refer to any number of blades in any construction or arrangement configured to mix the load when the shaft is rotated. The at least one radial arm 124 may be constructed from a single piece of material such as, for example, aluminum, and may be welded or otherwise bonded to shaft 122 by adhesive materials or other known bonding methods. The at least one blade 126 may be affixed to at least one radial arm 124 by known bonding methods. In some embodiments, the at least one blade 126 may include two or more blades organized as a blade set. It is contemplated that each blade set may be configured to agitate a different area in the interior of tank 102. It will be understood that other agitators, including agitators with numerous other constructions and/or blade arrangements may be used. Thus, as used herein, the term agitator includes any structure capable of mixing.

Each blade 126 may be constructed from a single piece of material such as, for example, aluminum, and may be connected to shaft 122 via radial arm 124. Each blade 126 may have any shape and/or size configured to facilitate mixing of the load into a substantially uniform blend of solids and liquids. In certain embodiments, each blade 126 may have a substantially rectangular or helix shape, having a substantially flat or curved surface portion. Each blade 126 may be arranged to be inclined towards shaft 122. In certain embodiments, each blade 126 may be inclined at about 6 degrees towards shaft 122.

In one exemplary embodiment, at least one radial arm 124 may include two or more radial arms 124 each having a substantially perpendicular arrangement relative to shaft 122. A set of blades 126 may be arranged on radial arms 124 to mix the load when the shaft is rotated. In the embodiment shown in FIG. 1, six sets of blades 126 are provided having a perpendicular arrangement about shaft 122. Other arrangements are contemplated. For example, in an alternative embodiment, blades 126 may not be affixed to radial arms 124 but rather may be fixed only to shaft 122.

At least one motor 128 may be provided to drive shaft 122. As depicted in FIG. 2, a single motor may be provided. It will be understood, however, that two or more motors may be provided. For example one motor may drive a forward set of blades 126 and another may drive a rearward set of blades 126. This may permit blades to be driven in either the same or opposite directions as may be desired to achieve thorough agitation of the bad in tank 102.

Motor 128 may be any known type of motor including, for example, a hydraulic motor, for rotating shaft 122. In certain embodiments, the rotational movement of shaft 122 may be about a generally vertical axis that extends in the elongated direction of tank (e.g., about a horizontal axis). Rotation may be in a clockwise direction and counterclockwise direction.

Shaft 122 may, for example, change the direction of rotation from clockwise to counter clockwise when the resistance for rotating clockwise is higher than a predetermined threshold. In situations where the tank is configured for use with flammable materials, it may be desirable to employ non-sparking motors.

The rotational frequency of shaft 122 may be determined based on the type of load in elongated tank 102. Alternatively, the rotational frequency of shaft 122 may be determined based on the viscosity level of the load. For example, if the load is relatively thick (i.e., high solid content), shaft 122 may rotate more slowly than if the load is relatively diluted (i.e., mostly liquid). By way of example only, shaft 122 may rotate at frequency of between 25 to 80 RPM.

Shaft support 130 may be configured to maintain shaft 122 in a rotatable manner within elongated tank 102. As used herein and throughout the disclosure, the term "shaft support" may refer to any known structure capable of holding shaft 122 above tank floor. For example, shaft support 130 may be a unitary frame that either partially or fully surrounds shaft 122. In some embodiments, shaft support 130 may be constructed from stainless steel or any other suitable material. Shaft support 130 may include bearing structures that receive opposing ends of shaft 122, and may include one or more additional structures for supporting shaft 122 at a location between the opposing ends. In alternative embodiments, shaft support 130 may include multiple discrete portions that are coupled to shaft 122 in at least two or more locations.

Figure 3:
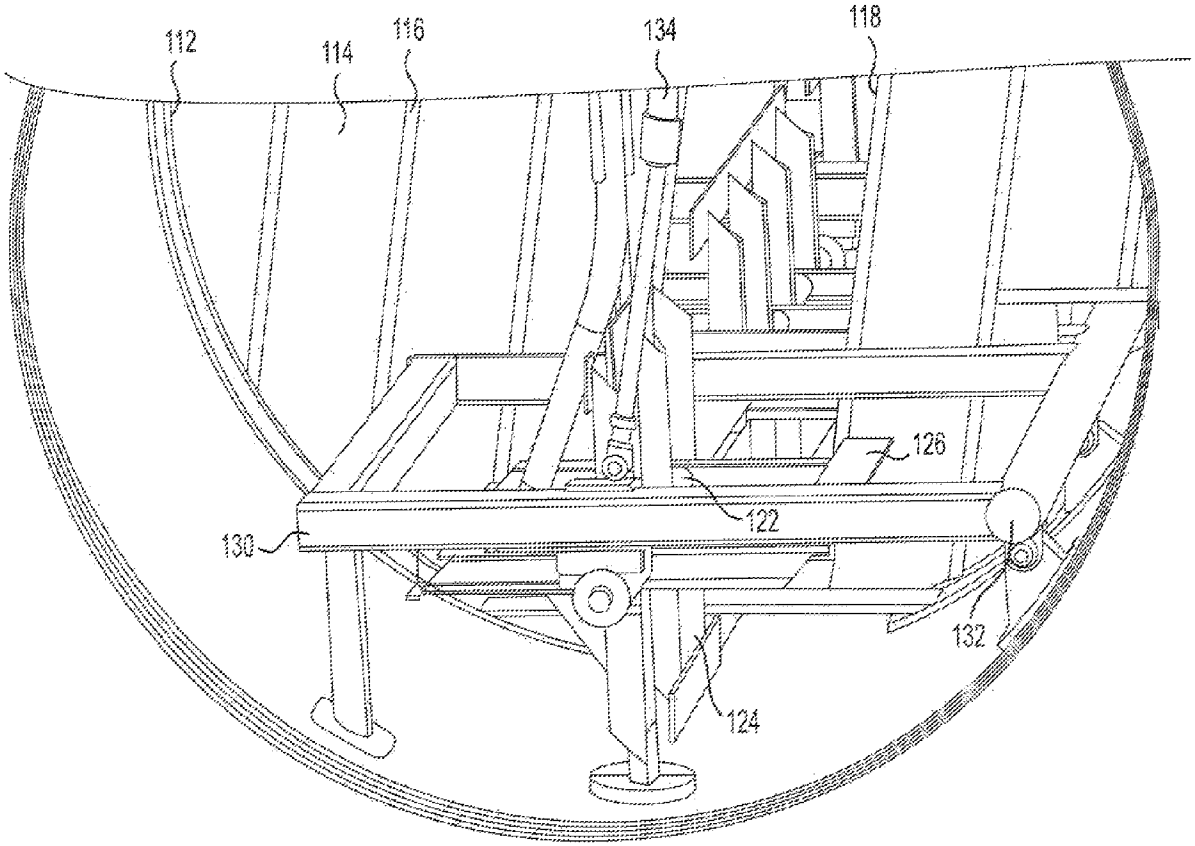
FIG. 3 is an enlarged partial side view of the agitator system, according to an embodiment of the disclosure.

In some embodiments of the invention, at least one actuator 134 may be provided. As shown in FIGS. 1 and 3, the at least one actuator 134 connected to shaft support 130. Further, shaft support 130 may be hingedly connected on one side of the inner surface of tank 102, via a structure such as hinge 132. By this arrangement, shaft support 130 may be configured to move in an upward direction from the lower portion 110*b* toward the upper portion 110*a*, and in a downward direction from the upper portion 110*a* toward the lower portion 110*b*. As used herein and throughout the disclosure, the term "movement in an upward direction" means movement away from the ground. In certain embodiments, shaft support movement can be vertical or diagonal, and may include a combination of horizontal and rotational movement as long as the resulting combined movement causes shaft 122 to move, in at least some respects, farther from the ground. As used herein and throughout the disclosure, the term "movement in a downward direction" means movement towards the ground. In certain embodiments, shaft support movement can be vertical or diagonal, or it may include a combination of horizontal and rotational movement as long as the resulting combined movement causes shaft 122 to move closer to the ground.

At least one actuator 134 may extend, for example, between the ceiling of elongated tank 102 and shaft support 130, and connect to shaft support 130 substantially above shaft 122. The at least one actuator 134 may be configured to regulate the upward direction and downward direction of shaft support 130 and, in turn, the position of shaft 122 in the upper portion 110*a* and lower portion 110*b* of elongated tank 102. Further, at least one actuator 134 may be configured to position shaft support 130 and shaft 122 at a predetermined position in upper portion 110*a* and lower portion 110*b*. Openings 118 in baffles 112 may facilitate movement in an upward direction and movement in a downward direction of shaft 122. In particular, openings 118 may permit movement without damage to the interior of tank 102.

The at least one actuator 134 may be any structure including known structures such as, for example, a piston, a pneumatic cylinder, a hydraulic cylinder, a gear, a ratchet, a track, a chain, a screw mechanism, and a winch. Further, the at least one actuator 134 may be operated by a source of energy such as, for example, electric current, hydraulic fluid pressure, pneumatic pressure, or any combination thereof. The actuator may convert its operating energy into either actuate movement and/or linear movement. In the exemplary embodiment, the at least one actuator 134 may include a plurality of actuators 134 e.g., two hydraulic cylinder (FIG. 1) extending from opposing ends of support shaft. Hydraulic cylinders may be coupled to a no-sparking motor e.g., a hydraulic motor (not shown). In certain embodiments, hydraulic cylinders may have a length of about 35-45 to 55-65 inches, and a cycle time of between 20 second to a half an hour. Depending upon intended usage, a control unit may be associated with the actuator for regulating one or more of the speed and degree of upward/downward movement of the actuator.

Figure 4A:
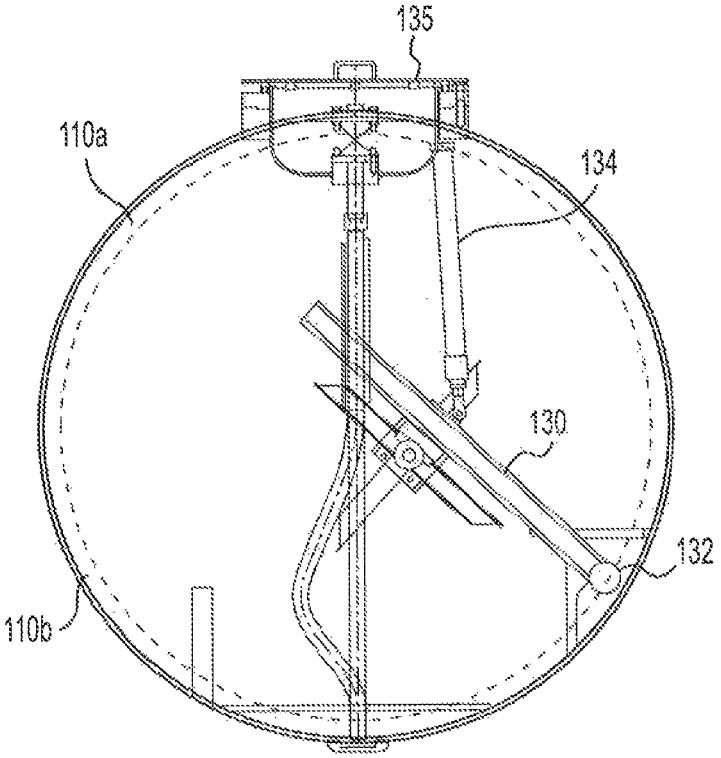
FIG. 4A is a schematic sectional view, with a shaft support of the agitator system in an upward position, according to an embodiment of the disclosure.
Figure 4B:
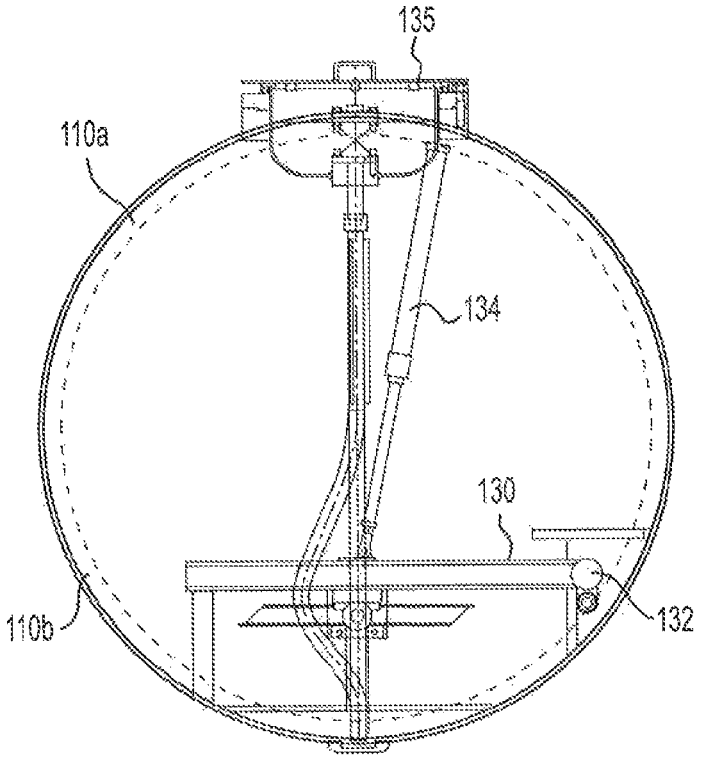
FIG. 4B is a schematic sectional view, with the shaft support in a downward position, according to an embodiment of the disclosure.

One or more hinges 132 may be provided on an inner surface of elongated tank 102 to enable shaft support 130 to pivot between upper portion (FIG. 4A) and a lower portion (FIG. 4B) as the at least one actuator 134 moves shaft support 130 in the upward direction and downward direction. Hinges 132 may be made from any suitable material known to one of ordinary skill in the art having sufficient durability to support shaft support 130. It will be understood that the number of hinges 132 may depend on, for example, the length of elongated tank 102 and the weight of shaft support 130. Actuators 134 may be configured to regulate a pivoting movement of shaft support 130 about hinge 132, pivoting direction (e.g., clockwise/counterclockwise), and its frequency. It is contemplated that in certain alternative embodiments, shaft support 130 may not be mounted to inner surface of tank 102 via hinge 132 but rather may be mounted only to the least one actuator 134.

Operation of apparatus 100 will now be described. In operation a tank 102 may be filled with a load containing solid and liquid constituents, where the solids tend to settle on the tank bottom. During transport and/or storage, actuator 134 may maintain shaft 132 and blades in an upper portion 110*a* of elongated tank 102. When it is desired to form a uniform mixture within elongate tank 102 (e.g., prior to discharge), motor 128 may be activated to rotate shaft 122 and cause turbulence in elongated tank 102. As shaft 122 rotates, actuators 134 may be adjusted to lower blades 126 towards lower portion 110*b* in order to mix the solids and liquids in a controlled manner. Because actuators 134 may maintain shaft 122 and blades 126 above a load of relatively thick content of high solids, and then lower the rotating blades slowly in the solids, the load may be mixed with minimal risk of the blades becoming stuck in the thick solids.

As noted above, shaft 122 may include segments 123 that are received by openings 118 in baffles 112. Segments 123 may rotate and move up and down through elongated openings 118 as actuators 134 moves shaft support between upper portion 110*a* and lower portion 110*b* of tank 102. Depending on the lifting mechanism employed, the elongated openings 118 may be vertical, angled, or curved to facilitate the path of lifting shaft 122 and, in turn, blades 126. With the shaft, blades, and baffles constructed in such a manner, the blades may be capable of moving up and down within the tank while the baffles substantially prevent migration of materials from one baffled compartment to another.

In certain additional embodiments, a feedback mechanism may be provided. As used herein and throughout the disclosure the term "feedback mechanism" may include a control that uses a sensor and a processor configured to provide information relevant to the load being mixed. The term "sensor" refers to any number of devices that measure a physical quantity related to the load and convert it into a signal which can provide information about a physical state of the tank contents. For example, the sensor may provide output to a processor, or may provide information that can be understood by a human. For example the sensor may be a pressure sensor, torque sensor, a viscometer, a thermal sensor, a speed sensor, a physical resistance sensor or any combination of thereof. The sensor together with a processor may be used to determine several parameters related to the movement of the shaft, for example: when to move the shaft in a downward direction, when to move the shaft in a upward direction, what is the optimal rotation frequency of the shaft etc. In this manner, feedback mechanism may be used with actuators 134 to regulate movement in an upward direction from lower portion to upper portion and movement in a downward direction from upper portion to lower portion.

By way of example, the motor(s) may have torque limitations that should not be exceeded. The feedback mechanism might sense an indicator of resistance in the load and maintain the rotating agitator at high enough level in the tank so that the torque limits or other parameter is not exceeded. When the resistance decreases, and the feedback mechanism so informs the processor, the processor may then lower the agitator further toward the bottom and/or increase the rotational speed of the blades. As the blades are lowered, the processor may slow the blades and as a sensed resistance is determined, the processor may increase the speed of blade rotation. Of course, the lowering/rotation logic can be adjusted to the contents of the load.

Other embodiments of the invention will be apparent to those skilled in the art from consideration of the specification and practice of the invention disclosed herein. It will be understood that the disclosed invention is broadly directed to lifting an agitator system in a tank, and that the disclosed lifting mechanism (e.g., actuators 134 and shaft support 120) is merely exemplary. Other lifting mechanisms including, for example, screw actuators and wheel and axle actuators, are envisioned and within the scope of the disclosure. It is intended that the specification and examples be considered as exemplary only, with a true scope and spirit of the invention being indicated by the following claims.

What is claimed is:

1. An apparatus for containing and mixing a load of liquids and solids, the apparatus comprising:

an elongated tank for containing the load, the tank including a lower portion and an upper portion;

an elongated rotatable shaft within the tank and arranged in an elongated direction of the tank;

at least one blade connected to the shaft, the blade being configured to mix the liquids and solids when the shaft is rotated;

a shaft support configured for maintaining the shaft in a rotatable manner within the tank, the shaft support being selectively moveable in a manner permitting the shaft to move in an upward direction from the lower portion toward the upper portion, and in a downward direction from the upper portion toward the lower portion; and an actuator contained within the tank for moving the shaft support in the upward direction and in the downward direction.

2. The apparatus according to claim 1, wherein the apparatus is mobile.

3. The apparatus according to claim 1, wherein the elongated tank is an ISO tank and includes a rectangular outer frame.

4. The apparatus according to claim 1, wherein the elongated tank is adapted to contain a hazardous load.

5. The apparatus according to claim 1, wherein the at least one blade has a substantially flat surface portion.

6. The apparatus according to claim 1, wherein the at least one blade includes a plurality of blades.

7. The apparatus according to claim 1, wherein the actuator is configured for rotating the shaft.

8. The apparatus according to claim 1, wherein the actuator is configured to move the shaft support up to a predefined position.

9. The apparatus according to claim 1, wherein the actuator is configured for concurrently regulating the shaft support movement in the downward direction and rotating the shaft.

10. The apparatus according to claim 1, further comprising a feedback mechanism configured to control at least downward movement of the shaft support as a function of rotational resistance of the shaft.

11. The apparatus according to claim 1, wherein the actuator includes at least one of a pneumatic cylinder, pneumatic piston, a gear, a belt, a chain, and a screw.

12. The apparatus according to claim 1, wherein the shaft is connected to the shaft support in at least two locations.

13. The apparatus according to claim 1, wherein the shaft support is mounted on a hinge on one side of the tank, and wherein the actuator is configured to cause the support to pivot about the hinge.

14. The apparatus according to claim 1, wherein the apparatus is configured to mix the load into a substantially uniform blend of solids and liquids.

15. The apparatus according to claim 1, further comprising:

a hydraulic motor for rotating the shaft;

a sensor configured to measure a hydraulic fluid pressure level; and a processor configured to regulate downward movement of the shaft support as a function of the measured hydraulic fluid pressure level.

16. An apparatus for mixing a load of liquids and solids, adapted to be configured within an elongated tank that includes a lower portion and an upper portion, the apparatus comprising:

an elongated rotatable shaft;

at least one blade connected to the shaft, the blade being configured to mix the liquids and solids when the shaft is rotated;

a movable shaft support configured for maintaining the shaft in a rotatable manner within the tank, the shaft support being selectively moveable in a manner permitting the shaft to move in an upward direction from the lower portion toward the upper portion, and in a downward direction from the upper portion toward the lower portion;

an actuator for moving the shaft support in the upward direction and the downward direction; and a sensor and a processor for determining when to move the shaft in the downward direction.

17. An apparatus for containing and mixing a load of liquids and solids, the apparatus comprising:

an elongated tank for containing the load;

at least one baffle partitioning the tank into at least two sections;

an elongated rotatable shaft within the tank, passing through the at least one baffle, the shaft having opposing shaft ends completely contained within the tank such that tank walls are impervious to the shaft; and at least one blade connected to the shaft, the blade being configured to mix the liquids and solids when the shaft is rotated.

18. The apparatus according to claim 17, wherein the at least one baffle is constructed of a plurality of sheets of metal having reinforcing ribs between edges of the metal sheets.

19. The apparatus according to claim 17, wherein the at least one baffle is constructed to withstand a g-force of at least 1.5 g.

20. The apparatus according to claim 17, further comprising a shaft support for rotatably holding the shaft, the shaft support being movable toward and away from a bottom of the tank.

21. The apparatus according to claim 17, wherein the at least one baffle includes a gap therein, the shaft being configured to pass through the gap.

22. The apparatus according to claim 16, wherein the moveable shaft support is configured to mount to a hinge on one side of the tank, and wherein the actuator is configured to cause the support to pivot about the hinge.

23. The apparatus according to claim 16, wherein the actuator is further configured for rotating the shaft.

24. The apparatus according to claim 16, wherein the moveable shaft support is configured to maintain the elongated rotatable shaft within the tank in an elongated direction of the tank.

25. The apparatus according to claim 16, wherein the actuator is configured for concurrently regulating shaft support movement in the downward direction and rotating the shaft.

* * * * *